US006786463B1

(12) United States Patent
Collum

(10) Patent No.: US 6,786,463 B1
(45) Date of Patent: Sep. 7, 2004

(54) TELESCOPING FORM

(76) Inventor: Stephen Allan Collum, 610 W. 20th St., Cedar Falls, IA (US) 50613

( * ) Notice: Subject to any disclaimer, the term of this patent is extended or adjusted under 35 U.S.C. 154(b) by 627 days.

(21) Appl. No.: 09/829,847

(22) Filed: Apr. 10, 2001

(51) Int. Cl.[7] ..... B28B 7/02
(52) U.S. Cl. ..... 249/134; 249/155; 249/160
(58) Field of Search ..... 249/35, 39, 134, 249/155, 160

(56) References Cited

U.S. PATENT DOCUMENTS

| | | | | |
|---|---|---|---|---|
| 28,715 | A | | 6/1860 | Godfrey |
| 1,507,721 | A | | 9/1924 | Waite |
| D164,494 | S | | 9/1951 | Hines |
| 2,684,518 | A | | 7/1954 | Whitlock |
| 2,728,126 | A | | 12/1955 | Whitlock |
| 3,933,336 | A | | 1/1976 | Tolf, Jr. |
| 4,035,976 | A | | 7/1977 | Downey |
| 4,170,853 | A | | 10/1979 | Kohaut |
| 4,515,271 | A | | 5/1985 | Auciello et al. |
| 4,589,624 | A | | 5/1986 | Jones |
| 4,823,527 | A | * | 4/1989 | Harbeke ..... 52/220.8 |
| 4,988,705 | A | | 1/1991 | Ganguly et al. |
| 5,156,755 | A | | 10/1992 | Cass |
| D364,413 | S | | 11/1995 | Ishida et al. |
| 5,496,213 | A | * | 3/1996 | Miller ..... 454/271 |

FOREIGN PATENT DOCUMENTS

| | | |
|---|---|---|
| WO | WO 93/08972 | 3/1993 |

* cited by examiner

*Primary Examiner*—James P. Mackey
*Assistant Examiner*—Donald Heckenberg
(74) *Attorney, Agent, or Firm*—McKee, Voorhees & Sease, P.L.C.

(57) ABSTRACT

A telescoping form for forming a void in poured concrete is disclosed. The form has an upper section defined by a plurality of sides, the upper section of plastic composition, and a lower section capable of telescoping into the upper section, the lower section of plastic composition. The telescoping form may be permanent. The telescoping form may have a lid removably mounted to the upper section of the form.

5 Claims, 4 Drawing Sheets

TELESCOPING FORM

BACKGROUND OF THE INVENTION

The present invention relates to concrete forms. More particularly, the present invention relates to a telescoping concrete form that may be permanent.

Concrete forms and their use are widely known. When laying concrete, concrete forms are positioned to create voids in the concrete. One common use for creating a void is to provide access to equipment, lines, or other objects that may lie underneath or behind a concrete slab.

The most widely used method of creating concrete voids is to use a wooden form. Typically, for each concrete job, a new wooden form is used. A wooden form is constructed to fill the void that is created in poured concrete. The creation of these forms can be labor intensive. In addition to constructing the wooden form, a hole will need to be created underneath the wooden form. The hole created must be larger than the void that is to be created. In addition, the depth of the cement must be sufficient to cover the height of the form walls, which can require added time and materials. Once the concrete is poured, leveled, smoothed, or otherwise prepared, it is set. The setting process of the concrete takes significant time. Typically, at least 24 hours is allowed for the concrete to set. After this time, the wooden forms must be removed from the concrete. Because of the amount of time required for the concrete to set, a contractor, plumber, or other professional must return to the site to remove the form. The wooden form must be removed because if it is left in the void, it will rot and/or attract insects such as termites. The wooden forms are difficult to remove because the wood is usually swollen from moisture and the cement is not fully cured. When the cement is in this state, it is particularly easy to chip. Once the form is removed, additional cement needs to be mixed in order to fill the bottom of the void and fix the chips or other imperfections in the walls. Then a lid, often a metal cover, is installed over the void. The lids are usually precut squares and often need to be modified in order for them to fit properly, as the void may not be perfectly square.

Thus there are a number of problems with this type of form and this procedure. These problems include the amount of time that it takes to create the form and the requirement that the form be removed after the cement has cured.

Therefore it is a primary object of the present invention to improve upon the state of the art.

It is a further object of the present invention to provide a concrete form that need not be removed.

Yet another object of the present invention is to provide a concrete form that may be inexpensively manufactured.

A further object of the present invention is to provide for a concrete form that does not require a metal lid.

Another object of the present invention is to provide for a concrete form that is adjustable to various heights.

A further object of the present invention is to provide for a lid that will fit a void without modification.

A still further object of the present invention is to provide a concrete form that eliminates the time and labor associated with building wooden forms.

Yet another object of the present invention is to provide a concrete form that eliminates the need for a separate trip to a job site to remove a form, or to pour a bottom of a void, or to place a lid.

Yet a further object of the present invention is to provide a concrete form that eliminates risks of chipping concrete while removing a form.

A still further object of the present invention is to remove the need for additional cementing to correct imperfections created when removing a form.

Another object of the present invention is to provide a concrete form that will not rust or rot.

Yet another object of the present invention is to provide a concrete form that is easy to drill.

These and other objects, features, and advantages of the invention will become more apparent from the following detailed description.

BRIEF SUMMARY OF THE INVENTION

The present invention is a concrete form. The concrete form may be telescoping in order to adjust the height of the form. The concrete form may be made out of a material such as plastic and need not be removed from a construction site.

Another aspect of the invention includes a lid that may be placed on the concrete form, the lid may be of a plastic material and may fit upon a lip of the concrete form.

Another aspect of the invention is a method for creating a concrete void. The form is adjusted to an appropriate height and placed to create a void. The form is secured in place by pouring concrete in an area in contact with the form.

DETAILED DESCRIPTION OF THE INVENTION

Figure 1:
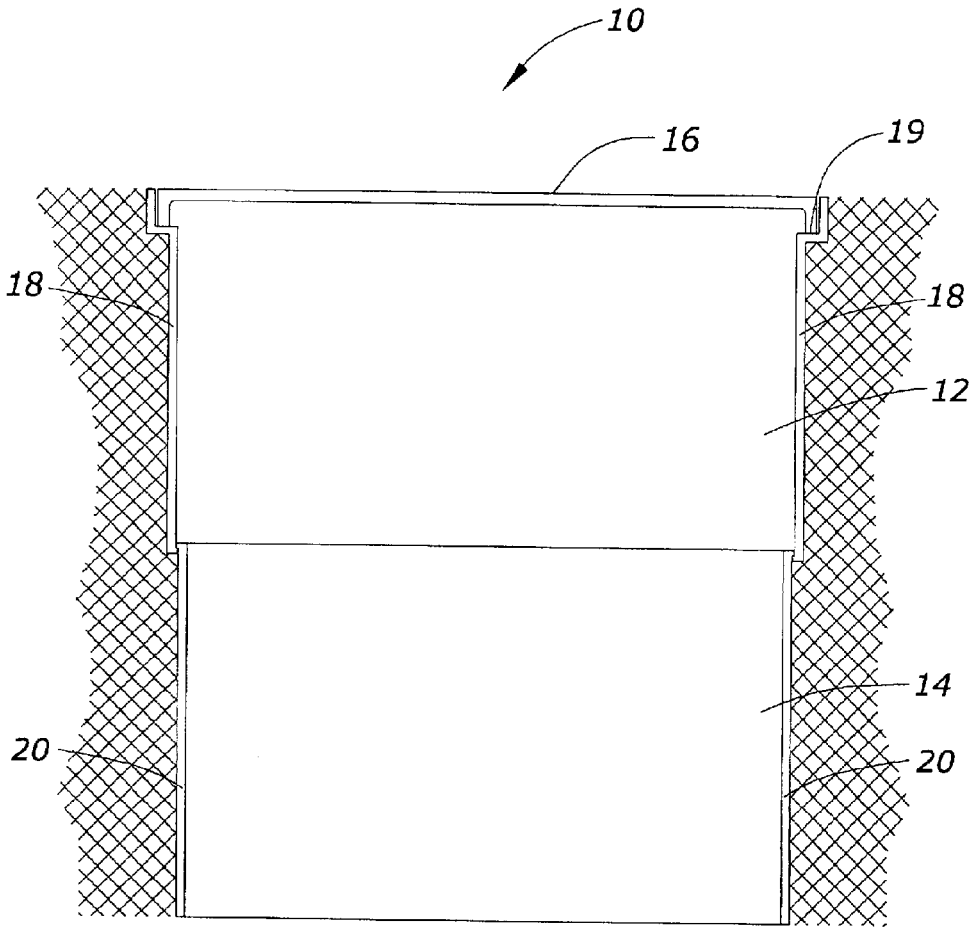
FIG. 1 is a side view of the concrete form of the present invention.

FIG. 1 illustrates the concrete form 10 of the present invention in a fully extended position. The concrete form 10 is shown having an upper section 12 and a lower section 14. Optionally, there is a lid 16 that may be placed on the form. Each section of the concrete form 10 has a number of sides. The upper section 12 has sides 18 while the lower section 14 has sidewalls 20.

The present invention is in no way limited to a particular shape of the concrete form. The concrete form may be rectangular as shown, or may be triangular, circular, irregular, tubular, polygonal, or other shape that may be appropriate for a particular job.

The present invention contemplates that the upper section may have an optional lip 19 to provide a support for an optional lid 16. In addition, the upper section 12 and the lower section 14 may have a lip or other structure performing the function of allowing the upper section 12 and lower section 14 to remain connected.

Figure 2:
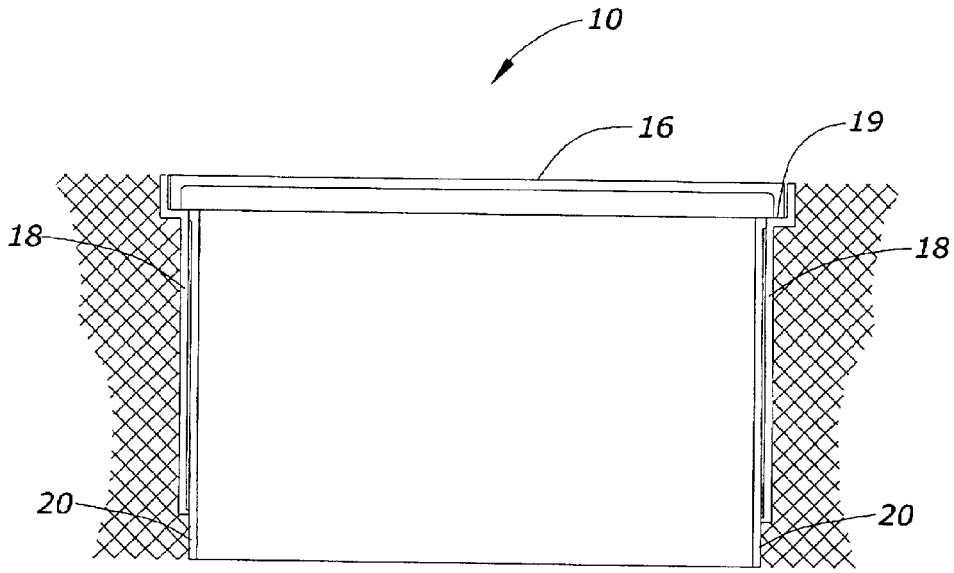
FIG. 2 is a side view of the concrete form of the present invention in an expanded position.

FIG. 2 illustrates the telescoping concrete form of the present invention in a fully retracted position. The sides 20 of the lower position are inside the sides 18 of the upper section. The telescoping feature of the present invention permits the height of the concrete form to be adjusted by telescoping the lower section 14 or a portion of the lower section 14 into the upper section 12.

The form may be manufactured out of a plastic such as a PVC plastic. The present invention contemplates that other materials may be used, but plastic has the advantage that it will not rot or rust.

The present invention contemplates that the height of the form may be set by telescoping the forms to the appropriate position and then securing the form. The form may be secured in a number of manners. One manner is to use a PVC plastic glue at the joint between the upper section and the lower section and then allowing the glue to set which takes only a few minutes. The present invention is no way limited to this method of securing, but this method is reliable.

The dimensions of the concrete form are dependent upon the particular use of the concrete form, including the size and shape of the void to be created. One convenient size is a square shaped concrete form that may vary in height from one-inch when only a lip is used to sixteen-inches in height when a form is fully telescoped, approximately 0.187 inches in thickness.

Figure 3:
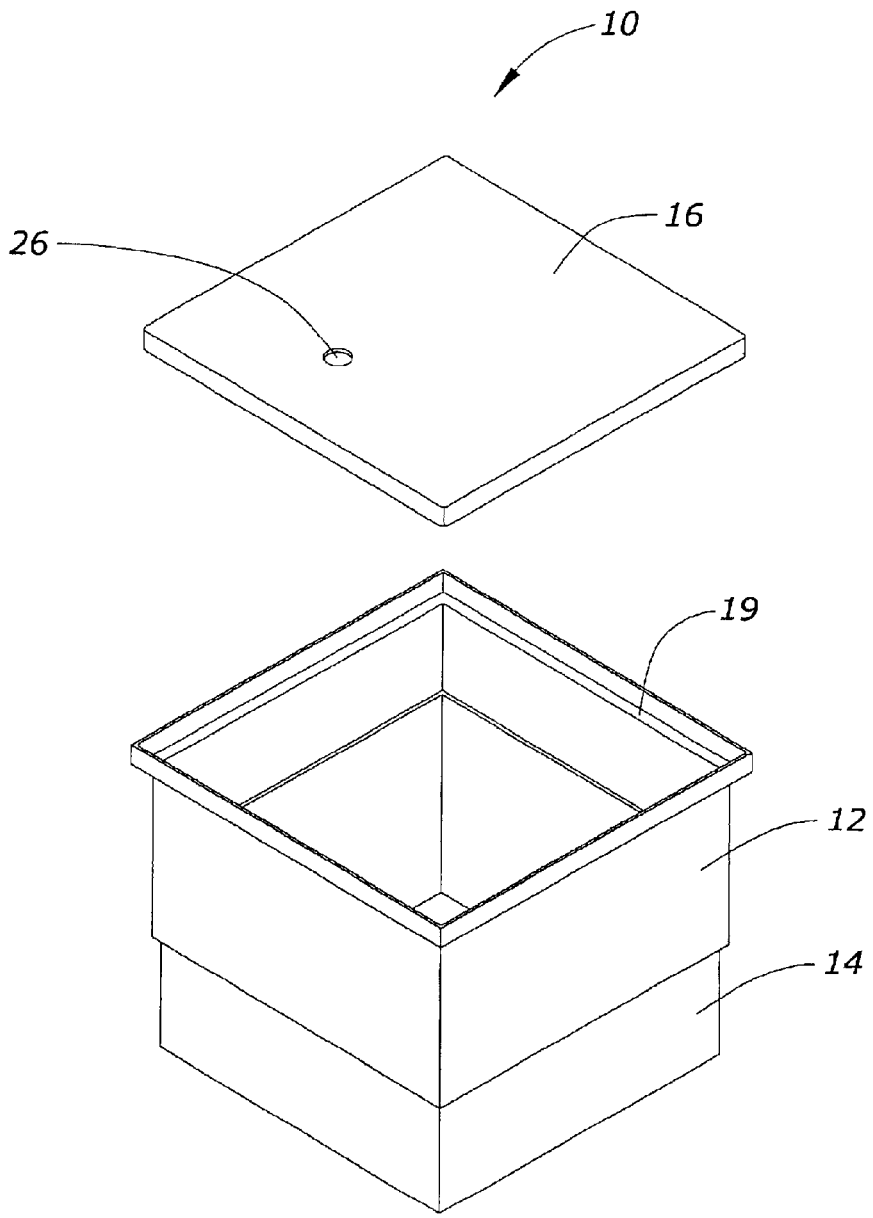
FIG. 3 is a perspective view of the concrete form and lid of the present invention.

FIG. 3 provides an exploded perspective view of the concrete form 10. A lid 16 may be placed on the upper section 12. The lid 16 may be of a plastic material, such as PVC plastic. Preferably, the lid 16 is of sufficient strength that the concrete void may be walked over.

Figure 4:
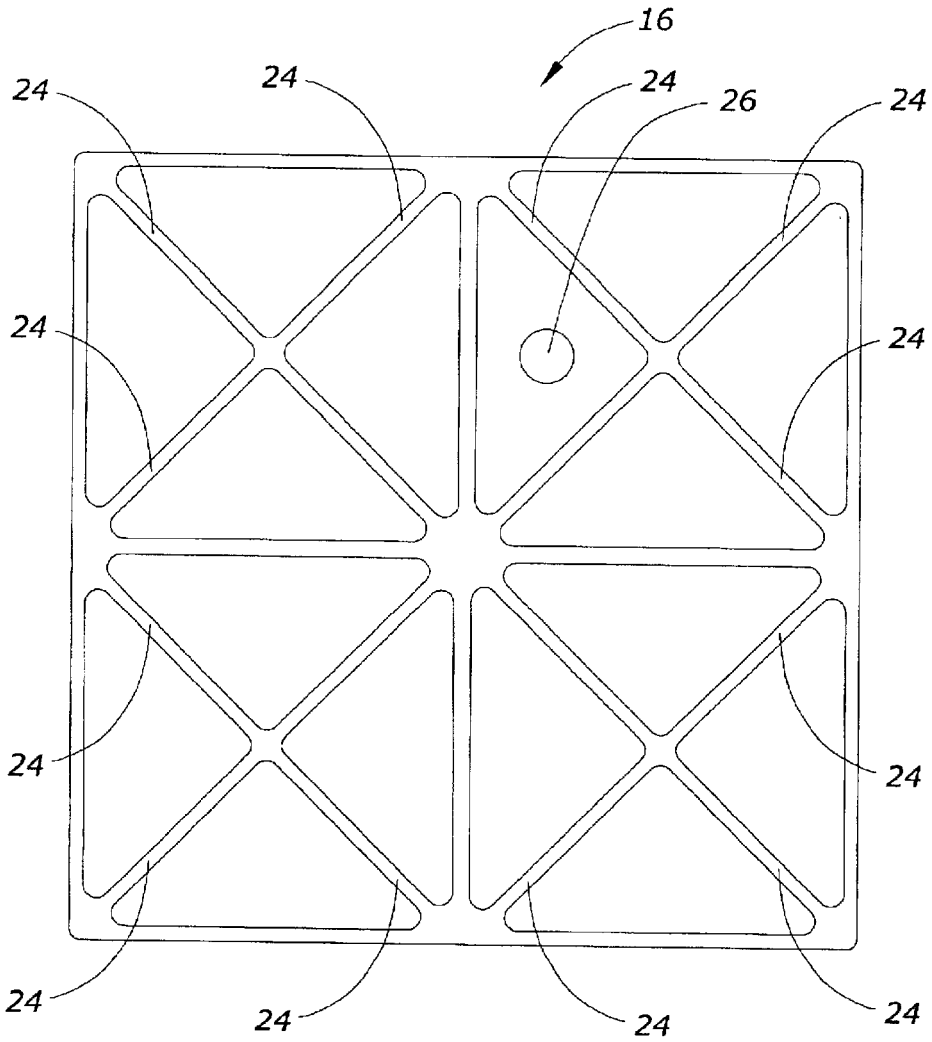
FIG. 4 is a top view of the lid of the present invention.

In FIG. 4, the lid 16 is shown. The lid 16 may include strengthening cross ribs 24 to increase the strength of the lid so that the lid may support a greater capacity. In addition, FIG. 4 illustrates the finger hole 26. The finger hole 26 may be a knock out finger hole. The finger hole 26 is used to facilitate the removal of the lid. The present invention contemplates that other structures may be used to facilitate removal of the lid. The use of the finger hole is merely a convenient method that does not add to the manufacturing cost of the lid and may be walked over without falling through or tripping. As can be appreciated, the concrete form made of plastic is easy to drill.

The use of the concrete form provides an improved method of creating concrete voids. The concrete form may be adjusted to a particular depth appropriately sized for the concrete void to create. The depth of the telescoping form may then be secured. The concrete form can then be placed in the area where the void is to be created by surrounding the area on one or more sides by cement. Cement may then be poured into the area surrounding the form, securing the form in a permanent position. Because the form is inexpensive and because it will not rot or rust, it may be permanent. This also allows the bottom of the void to be poured at the same time. Therefore there is no need to return to a site to remove the form to touch up the walls, to pour a floor, and/or to place a cover over the void, such as may be required with other forms.

A concrete form having important advantages and features has now been described. It should be apparent that the present invention contemplates numerous variations in the type of material used, dimensions of the form, the shape of the form, the method and structure of securing a lid, the method and structure of securing the sections of the form, and the method and structure of providing for removal of the form.

What is claimed is:

1. A telescoping form for forming a void in poured concrete comprising:

an upper section defined by a plurality of sides, the upper section of plastic composition;

a lower section capable of telescoping into the upper section, the lower section of plastic composition;

a lid removably mounted on the upper section of the form;

wherein the lid further comprises a plurality of cross ribs.

2. The telescoping form of claim 1 wherein the plastic composition of the upper section and the lower section is PVC.

3. The telescoping form of claim 1 wherein the lid further comprises a finger hole for facilitating removal of the lid.

4. The telescoping form of claim 1 further comprising a lip on the upper section for receiving the lid.

5. The telescoping form of claim 1 further comprising a lip on the upper section and a lip on the lower section, the lip on the upper section and the lip on the lower section contacting in a fully extended telescoping position.

* * * * *